US006260409B1

(12) United States Patent
Briaud et al.

(10) Patent No.: US 6,260,409 B1
(45) **Date of Patent: *Jul. 17, 2001**

(54) APPARATUS AND METHODS FOR PREDICTION OF SCOUR RELATED INFORMATION IN SOILS

(75) Inventors: Jean-Louis C. D. Briaud, College Station, TX (US); Francis Chi Kin Ting, Bookings, SD (US); Hamn-Ching Chen, College Station, TX (US); Subba Rao Gudavalli, Cypress, TX (US); Suresh Babu Perugu; Gengsheg Wei, both of College Station, TX (US)

(73) Assignee: The Texas A&M University System, College Station, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/266,702

(22) Filed: Mar. 11, 1999

Related U.S. Application Data

(60) Provisional application No. 60/077,732, filed on Mar. 12, 1998.

(51) Int. Cl.[7] ..... G01N 17/00
(52) U.S. Cl. ..... 73/86
(58) Field of Search ..... 73/86, 864.44, 73/864.45

(56) References Cited

U.S. PATENT DOCUMENTS

| | | | | |
|---|---|---|---|---|
| 4,855,966 | | 8/1989 | Cinquino | 367/99 |
| 5,243,850 | * | 9/1993 | Hanson | 73/86 |
| 5,279,151 | * | 1/1994 | Coody et al. | 73/86 |
| 5,479,724 | | 1/1996 | Nahajski et al. | 33/719 |
| 5,522,271 | * | 6/1996 | Turriff et al. | 73/864.45 |
| 5,753,818 | | 5/1998 | Mercado | 73/594 |

FOREIGN PATENT DOCUMENTS

| | | | | |
|---|---|---|---|---|
| 0459749A1 | | 4/1991 | (EP) . | |
| 1099857 | * | 6/1984 | (SU) | 73/86 |

OTHER PUBLICATIONS

Experiments on the Scour Resistance of Cohesive Sediments, Journal of Geophysical Research, vol. 67, No. 4, Apr. 1962.

* cited by examiner

*Primary Examiner*—Robert Raevis
(74) *Attorney, Agent, or Firm*—Shawn, Hunter Bracewell & Patterson, L.L.P.

(57) ABSTRACT

Methods are described for measurement and prediction of site specific scour around a structure obstructing a flow. Representative soil samples are collected from an area proximate the structure location and tests are conducted on the samples to determine the erosion rate and hydraulic shear stress imposed. The maximum shear stress and initial scour rates around the structure are also obtained. Next, the maximum depth of scour is calculated, and the depth of scour versus time curve for the structure is then predicted. In a preferred embodiment, the methods described are used to predict a scour depth versus time curve around a cylindrical bridge support standing in the way of a constant velocity flow and founded in a uniform cohesive soil. An erosion function apparatus is also described which can be used to test representative samples of soil in the area where a structure is located.

19 Claims, 6 Drawing Sheets

FIG.6A
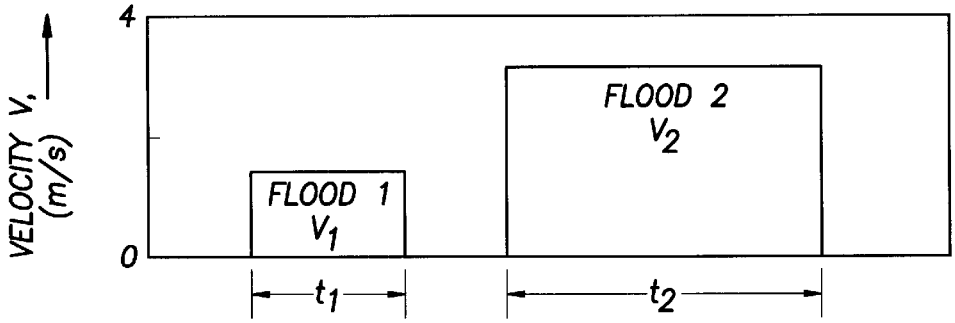
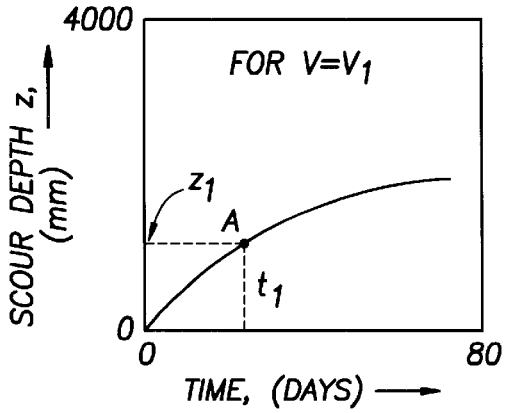
FIG.6B
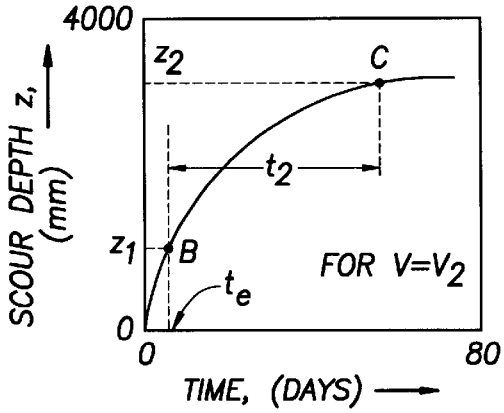
FIG.6C
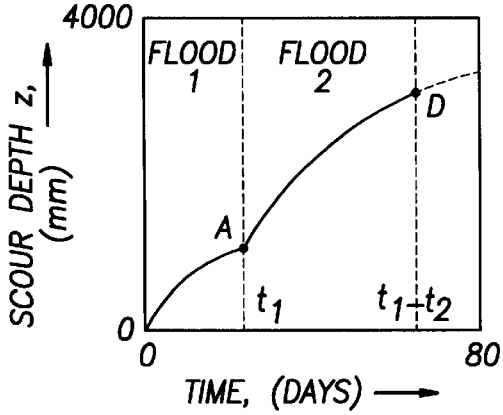
FIG.6D

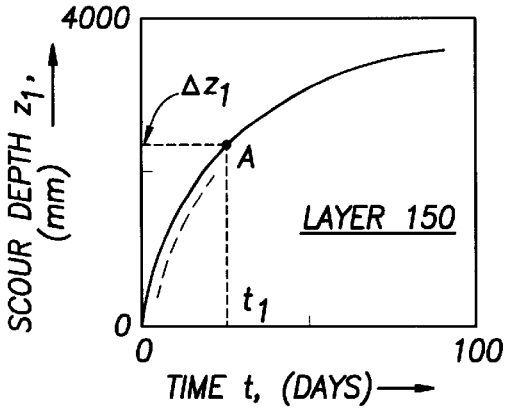
FIG. 7A
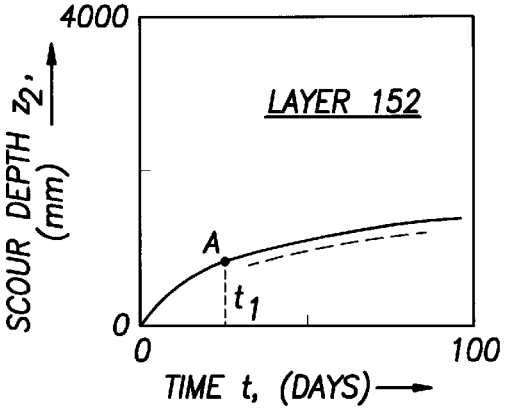
FIG. 7B
FIG. 7C
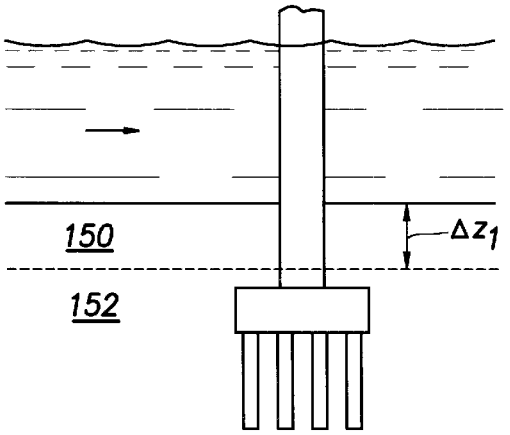
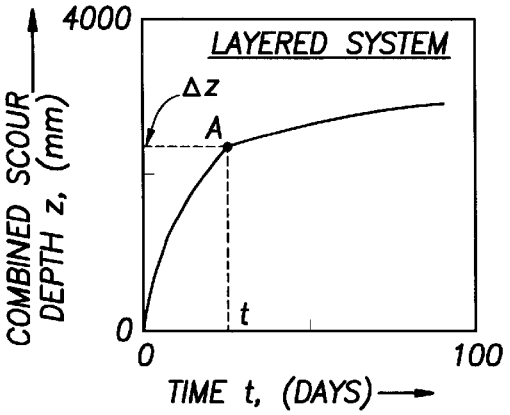
FIG. 7D

APPARATUS AND METHODS FOR PREDICTION OF SCOUR RELATED INFORMATION IN SOILS

CROSS-REFERENCE TO RELATED APPLICATIONS

This application claims priority of provisional application Ser. No. 60/077,732 filed Mar. 12, 1998.

STATEMENT REGARDING FEDERALLY SPONSORED RESEARCH OR DEVELOPMENT

Not Applicable.

BACKGROUND OF THE INVENTION

1. Field of the Invention

The present invention relates generally to the measurement and prediction of scour rate in soils. It has been found that the invention has particular applicability to the measurement and prediction of scour rate in cohesive soils at bridge supports and other structures that obstruct the flow of a body of water.

2. Description of the Related Art

There are approximately 600,000 bridges in the United States, and 500,000 of them are over water. During the last thirty years, over 1,000 of the 600,000 bridges have failed, and 60% of those failures are due to scour of the soil surrounding bridge piers or other supports. Earthquakes, by comparison, account for only 2% of bridge failures. The average cost for flood damage repair of highways on the federal aid system is $50,000,000 per year. Clearly, bridge scour is a significant problem deserving of significant study and attention.

Bridge scour can be divided into general scour, local scour and channel migration. General scour is general erosion of a stream bed without obstacles. Local scour is generated by the presence of obstacles such as piers and abutments, while channel migration is lateral movement of the main stream channel.

When bridges are designed, core samples are usually taken of the soil in the area where the bridge supports will be located. However, these samples are not typically tested to determine their susceptibility to local scour. Rather, a maximum scour depth is calculated and applied to the bridge design regardless of the actual soil present. The scour depth for sand is usually used and, if the soil is more scour resistant than sand, the bridge may be overdesigned, resulting in a significantly higher cost for the structure. If, on the other hand, scour is ignored, the bridge may be prone to failure earlier than planned. It is important, then to be able to accurately predict or forecast the actual rate of scour for a given location as well as the maximum depth of scour that can be expected for a given period of time.

Current scour prediction practice is unable to account for different soil types. Current practice is heavily influenced by two FHWA hydraulic engineering circulars called HEC-18 and HEC-20 (Richarson and Davis, 1995; Lagasse et al., 1995). For pier scour, HEC-18 recommends the use of the following equation to predict the maximum depth of scour ("$z_{max}$") above which all soil resistance must be discounted:

$$z_{max}=2z_0K_1K_2K_3K_4\ (D/z_0)^{0.65}F_0^{0.43}$$

where $z_0$ is the depth of flow just upstream of the bridge pier excluding local scour, $K_1$, $K_2$, $K_3$, $K_4$ are coefficients to take into account the shape of the pier, the angle between the direction of the flow and the direction of the pier, the stream bed topography, and the armoring effect. D is the pier diameter, and $F_0$ is the Froude number defined as $v/(gz_0)^{0.5}$ where v is the mean flow velocity and g is the acceleration due to gravity.

However, nothing in HEC-18 gives guidance to calculate the rate of scour in clays and it is implied that the HEC-18 equation should also be used for determining the final depth of scour for bridges on clays. Clays generally scour much more slowly than sand. Thus, using the HEC-18 equation for clays, regardless of the time period over which scour is considered, is probably overly conservative. As a result, bridges constructed based upon such an analysis may be excessively expensive.

In addition, it is probably improper to try to extrapolate a single representative critical shear stress for all clays. Other phenomena, not present in most sands, give cohesion to clays, including water meniscus forces and diagenetic bonds due to aging, such as those developing when a clay turns to rock under pressure and over geologic time. Because of the number and complexity of these phenomena, it is very difficult to predict $\tau_c$ for clays on the basis of a few index properties. As a result, the inventors consider it preferable to measure $\tau_c$ directly for a proposed bridge site.

Some devices are known that have been used to test the scour resistance of cohesive soils. One such device is described by Walter L. Moore and Frank D. Masch, Jr. in "Experiments on the Scour Resistance of Cohesive Sediments," vol. 67, no. 4, *Journal of Geophysical Research*, pp. 1437–1449 (1962). The device described there is a "rotating cylinder apparatus" wherein a cylinder of cohesive soil 3 inches in diameter and 3 inches long is mounted coaxially inside a slightly larger transparent cylinder that can be rotated at any desired speed up to 2500 rpm. The annular space between the cylindrical soil sample and the rotating cylinder is filled with a fluid to transmit shear from the rotating cylinder to the surface of the soil sample. The soil samples are mounted in the machine with enough water to fill the annular space to the top. The speed of rotation of the outer cylinder is gradually increased until visual observation indicates the presence of scour on the surface of the sample. At this point, a reading is made by a torque indicator. The measured torque is then converted into a shear stress on the soil surface.

There are a number of drawbacks to this type of device. First, the cylindrical soil samples used are mixed to a certain consistency and molded to form the sample. The mixing and molding can materially change the erosion characteristics of the soil being tested since the soil may not be representative of the compaction and consistency of in-place soil.

Further, the method of testing using the rotatable cylinder apparatus requires the sample to be rotated at progressively more rapid rates until erosion or scour is observed. The rate of scour is not tested at a specific velocity and over a specific length of time to provide an erosion rate.

A need exists for devices and methods that can accurately measure and predict scour, scour rates and related information, near bridge piers and the like.

SUMMARY OF THE INVENTION

In the present invention, methods are described for measurement and prediction of site specific scour. Representative soil samples are collected from an area proximate the bridge support location and tests are conducted on the samples to determine the erosion rate and hydraulic shear stress imposed. The maximum shear stress and initial scour rate are also obtained. Next, the maximum depth of scour is calculated, and the depth of scour is then predicted. In a preferred embodiment, the methods described are used to predict a scour depth versus time curve around a cylindrical bridge support standing in the way of a constant velocity flow and founded in a uniform cohesive soil.

An erosion function apparatus is also described which can be used to test representative samples of soil in the area where a bridge support will be located.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIGS. 6A, 6B, 6C and 6D show portions of an analysis of scour depth versus time wherein successive flood events are considered.

FIGS. 7A, 7B, 7C and 7D illustrate portions of an analysis of scour for a bed containing layers of different materials.

DETAILED DESCRIPTION OF THE PREFERRED EMBODIMENT

The invention will be described herein with specific reference to bridge supports, such as piers. It will be understood, however, by those of skill in the art that the invention also has applicability to all other obstructions to flow within a body of water around which scour might potentially occur. Bridge supports and the like are constructed and seated in all types of soils and materials, including sand, clay, limestone and other rock formations, cements and so forth. Therefore, the term "soil," as used herein, is meant to refer to all of these different types of materials.

The methods and devices of the present invention do not require the use of probes or periodic underwater monitoring. The present invention is generally intended as a site specific scour prediction method because representative soil samples from a bridge site are collected and tested.

Figure 1:
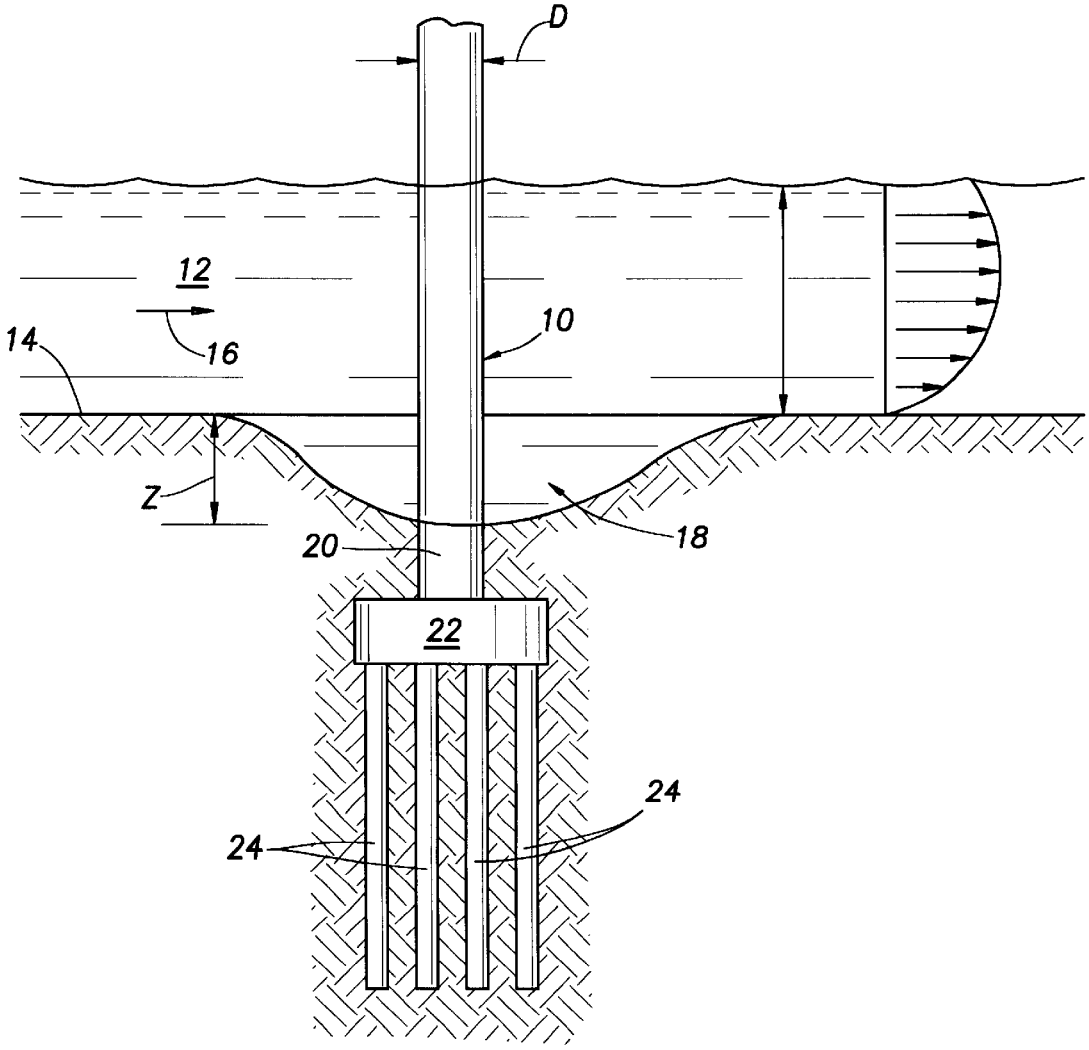
FIG. 1 is a graphic depiction of scour around a bridge pier.

Referring first to FIG. 1, an exemplary bridge support 10 is shown which is vertically disposed within water 12 and into the bed 14 beneath the water 12. The support 10 has a diameter "D" and supports a bridge (not shown). The water 12 has a current that moves the water 12 generally in the direction shown by the arrow 16. FIG. 1 also depicts a scour hole 18 with a depth of "Z" that has developed around the bridge support 10. The bridge support 10 includes a central vertical member 20 that is seated on a horizontal platform 22 that in turn is supported by a plurality of subpiers 24. It should be understood that this particular construction for a bridge support is exemplary only and is not intended to limit the claimed invention.

Figure 2:
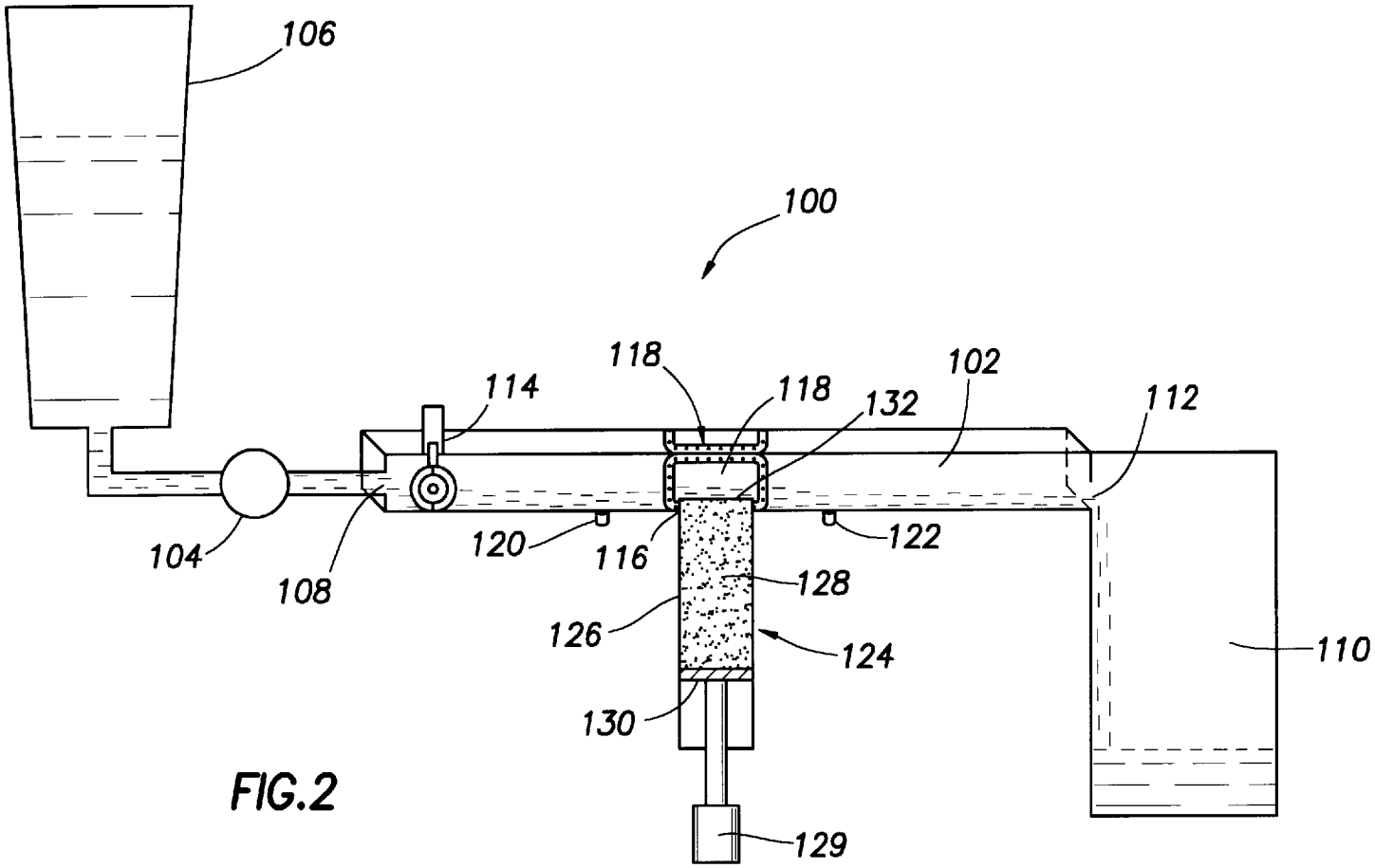
FIG. 2 depicts an exemplary erosion function apparatus.

FIG. 2 is a diagram depicting an exemplary erosion function apparatus 100 which can be used to determine the actual erosion rates, or scour rates, and hydraulic shear stresses imposed upon soil samples obtained near the bridge support 10. The erosion function apparatus 100 includes a water flow conduit 102 that is operationally interconnected with a pump 104 and water source 106 at the inlet 108 of the water flow conduit 102 for flowing water therethrough. A collection receptacle 110 is operationally associated with the outlet 112 of the water flow conduit 102.

A flowmeter 114 is operationally interconnected with the conduit 102 such that the velocity of water flowed through the conduit is measured. The flowmeter 114 may comprise a spinner-type flowmeter of a type known in the art. However, other designs for flowmeters and other types of flow measurement can be used as well. A soil sample aperture 116 is cut into the lower side of the water flow conduit 102, and viewing windows 118 are located on the top and two sides of the water flow conduit 102 adjacent the soil sample aperture 116. It is currently preferred that the water flow conduit 102 be substantially rectangular in cross-section as the substantially flat bottom of the conduit 102 will simulate the substantially flat bottom of the bed 14.

Pressure sensors 120, 122 are located on the upstream and downstream sides of the soil sample aperture 116. As will be explained shortly, the use of the pressure sensors 120, 122 are used to help determine the shear stress $\tau$ and maximum shear stress $\tau_{max}$ proximate the bridge support 10. The sensors 120, 122 preferably comprise pressure sensitive transducers, and they are operatively associated with a computer or other device that is capable of detecting the differential pressure $\Delta p$ of the pressures detected by the two sensors 120, 122. Such devices are well known in the art.

A soil sample apparatus 124 is affixed to the lower side of the water flow conduit 102 so that soil may be selectively pushed or urged into the conduit 102. The soil sample apparatus 124 includes a soil containing cylinder 126 which is shown having a soil sample 128 contained therein. It is presently preferred that the soil containing cylinder 126 comprise a 76.2 mm diameter Shelby tube of a type known in the art. The upper end of the cylinder 126 is fitted within or otherwise affixed to the soil sample aperture 116 so that the soil sample 128 can be selectively moved through the aperture 116 and into the conduit 102. A reciprocable piston 130 is located proximate the lower end of the cylinder 126 below the soil sample 128. The piston 130 should be movable within the cylinder 126 in small increments, such that a small amounts of the soil sample 128, i.e. cylindrical portions approximately 0.1 mm in height, can be selectively moved into the conduit 102 and subject to erosion by the flow of water through the conduit 102. A motor 129 is used to actuate the piston and move it upward or downward within the cylinder. The motor 129 is preferably a step-type motor that will move the piston 130 upwardly in small, measured increments.

The erosion function apparatus 100 is used to test a representative soil sample and allow, using those tests, prediction of the scour depths and rates of scour for areas in the bed 14 around a particular bridge support, such as support 10 using projected velocity rates and selected time periods. As a result, more realistic planning may be done as a bridge is designed to ensure that the bridge is neither overdesigned nor underdesigned for scour.

Determination of Scour Rates

According to the methods of the present invention, at least one representative soil sample, such as sample 128, is taken from the area proximate the proposed or existing location for a bridge support such as a pier. The soil sample is preferably taken in an area of shallow water within the river. If desired, a barge may be used and the soil sample obtained from the barge. Alternatively, the soil sample may be taken from an on-shore location near the river. The soil sample is captured in a cylinder which is driven into the soil by a drill rig of a type known in the art. The cylinder is then removed from the soil with a sample retained therein. As noted previously, the preferred cylinder for use in collecting and testing such samples is presently a 76.2 mm Shelby tube. The use of the cylinder permits a sample of the soil to be collected that is substantially representative of the soil in-place. The soil is not compacted or reshaped in order to provide a sample for testing.

Once the soil sample is obtained, the soil containing cylinder is placed into the erosion function apparatus 100, as described earlier. The piston 130 is actuated to urge a protruded portion 132 of the soil sample 128 through the aperture 116 and into the flow bore of the water flow conduit 102. The protruded portion 132 extends a preferred linear distance, or height, above the lower surface of and into the conduit 102, thereby becoming subject to erosion by water flowed through the conduit 102. Suitable heights for the sample portions protruded into the conduit 102 are 0.1 mm, 0.5 mm and 1 mm above the inner lower surface of the conduit 102. A presently preferred height for the protruded portion 132 is 1 mm as such appears to provide a sufficient amount of soil within the conduit 102 in order to determine erosion rates for the soil through visual observation at different flow rates and for different types of soils. Sands, for example, erode very quickly while compacted clays and limestone-based soils erode more slowly.

When a protruded portion 132 of the soil sample 128 has been pushed into the conduit 102, as described, the pump 104 is then actuated to flow water from the water supply 106 through the water flow conduit 102 and into the collection receptacle 110. Water is flowed by the pump 104 at a predetermined velocity v as measured by the flowmeter 114. An observer visually observes the protruded portion 132 of the soil sample 128 through the transparent viewing windows 118 and records the amount of time required for the protruded portion 132 of the soil sample 128 to erode, thus providing the measured rate of scour $\dot{z}$ for the sample 128 at that water velocity v.

Following erosion, the soil sample 128 can then be advanced by the piston 130 to project another protruded portion 132 into the conduit 102. Several successive tests are performed in this manner. The process is repeated for at least one hour and leads to an average erosion rate $\dot{z}$ for the velocity v.

Next, erosion tests of this type are performed for a range of water flow velocities v varying between 0.1 meters per second to 6 meters per second, as this range of flow velocities should include the expected flow velocities for most bodies of water under natural conditions.

Determination of Shear Stresses

The inventors have recognized that the scour process is highly dependent on the shear stress $\tau$ developed by the flowing water at the soil-water interface. Indeed, at that interface the flow is tangential to the soil surface regardless of the flow condition above it because very little water, if any, flows perpendicular to the soil-water interface. If the water velocity v in the water 12 is in the range of 0.1 m/s to 3 m/s, the bed shear stress $\tau$ is in the range of 1 to 50 N/m$^2$. The shear stress increases with the square of the water velocity v.

Shear Stress in the Erosion Function Apparatus 100

The pressure sensors 120, 122 upstream and downstream of the sample location provide the differential pressure $\Delta p$ necessary to calculate the shear stress $\tau$ applied by the water. The following equation is used:

$$\tau = R/2 \times \Delta p/l$$

where R is the radius of the pipe and $\Delta p/l$ is the pressure drop ($\Delta p$) per length (l) of pipe. Alternatively, the pressure drop can be calculated by using the Moody Chart (Moody, L. F., "Friction Factors for Pipe Flow," *Transactions of the ASME*, Vol. 66, 1944).

Figure 3A:
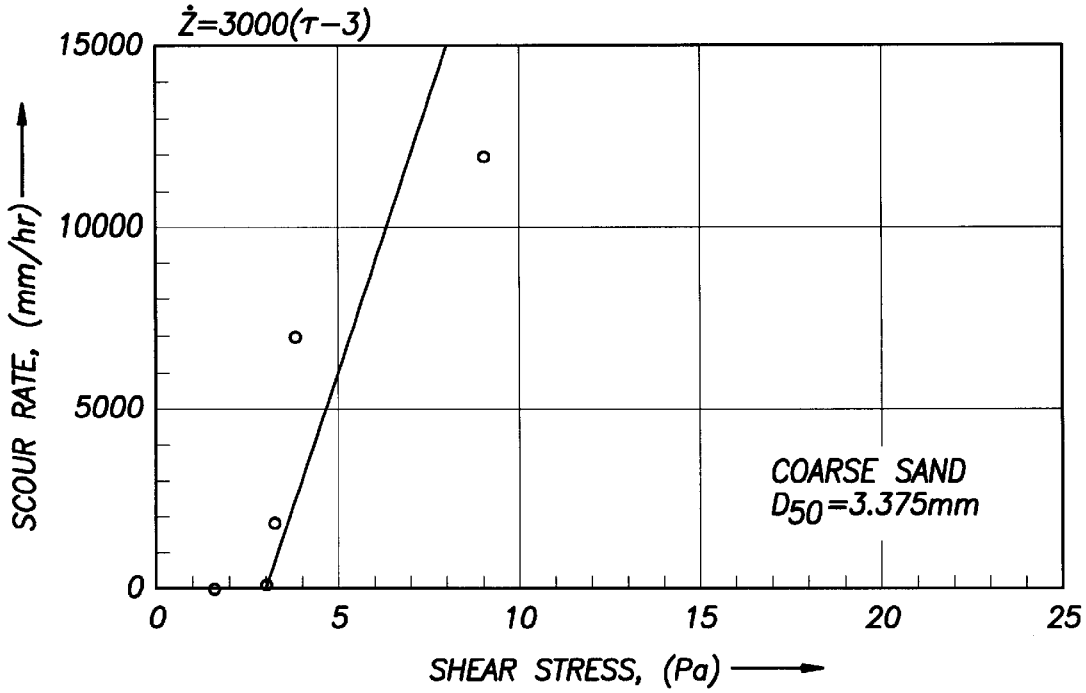
FIGS. 3*a* and 3*b* are tables showing scour rates versus applied shear stress for two exemplary soil samples.
Figure 3B:
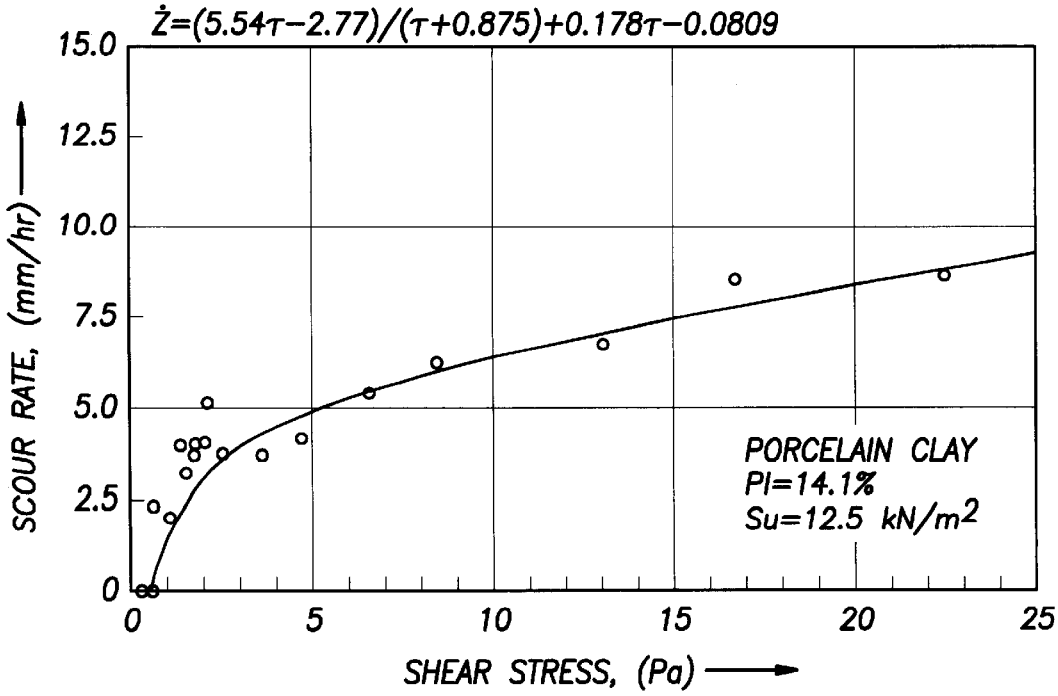

A $\dot{z}$ vs. $\tau$ curve is then developed for different fluid flow rates or velocities v using data points obtained from testing the soil sample at various fluid flow velocities. Representative curves for coarse sand and porcelain clay are shown in FIGS. 3A and 3B, respectively.

Maximum Shear Stress Around a Pier

Figure 4:
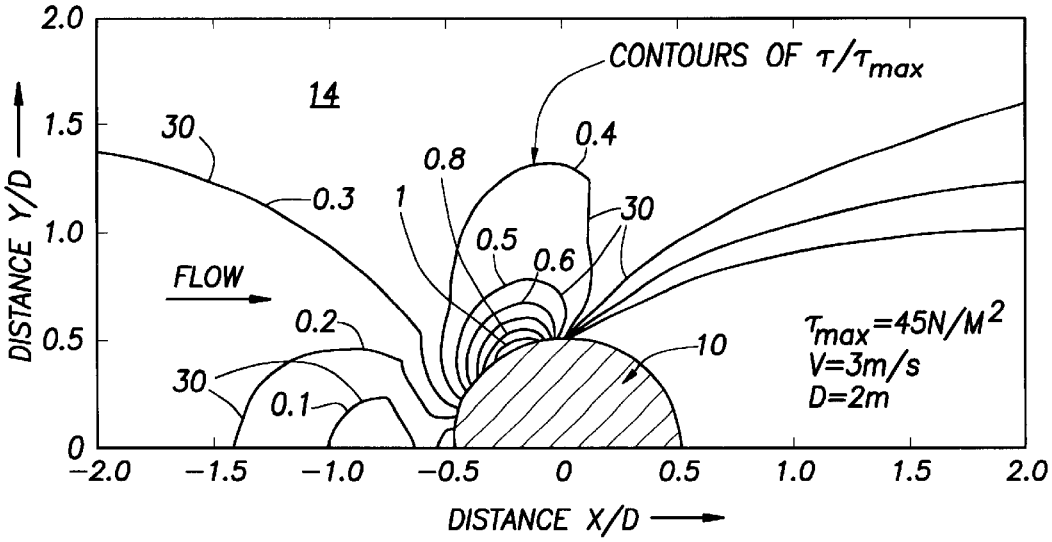
FIG. 4 illustrates the mapping of expected locations for scour around a cylindrical pier.

When an object obstructs the flow in an open channel with a flat bottom, the maximum shear stress $\tau_{max}$ is many times larger than the shear stress value when there in no obstruction. FIG. 4 shows an exemplary distribution of the value of the shear stress $\tau$ (expressed as a ratio of $\tau$ to $\tau_{max}$) at various locations around a pier 10. Contours 30 are provided which map the locations and provide boundaries for the locations of specific shear stress values.

A cylindrical obstruction, representative of the shape of many bridge support structures, is used as an example here. However, it should be understood that the inventive methods are easily generalized to structures having other cross-sectional shapes.

The maximum shear stress $\tau_{max}$ at bridge support 10 can be calculated based upon the size of the support 10 that is to be placed in the bed 14. For example, if the bridge support 10 is a cylindrical structure, and the bed 14 forms a substantially flat surface, the maximum shear stress $\tau_{max}$ is dependent upon the Reynold's number $R_e$, the mean flow velocity V and the mass density p of the water 12. The following equation, developed using the Chimera-RANS numerical method, is used:

$$\tau_{max} = 0.094\ p\ V^2(1/\log R_e - 1/10)$$

where the Reynold's number $R_e$ is defined as VD/v where V is the mean flow velocity, D is the diameter of the bridge support 10, and v is the kinematic viscosity of the water 12 ($10^{-6}$ m$^2$/s at 20° C.). If this value of $\tau_{max}$ is larger than the critical shear stress $\tau_c$ that the soil can resist, scour is initiated. As the scour hole 18 deepens around the support 10, the shear stress $\tau$ at the bottom of the hole 18 decreases.

Critical Shear Stress

The critical shear stress $\tau_c$ is considered to be the shear stress $\tau$ that will generate a predetermined minimum scour rate. For example, the critical shear stress $\tau$ for soils tested using the erosion function apparatus 100 can be the shear stress which results in an erosion of 1 mm/hr (24 mm/day) of the tested soil sample.

The initial scour rate $\dot{z}_i$ is then read on the $\dot{z}$ versus $\tau$ curve, obtained as described earlier from the erosion function apparatus 100, at the value of $\tau_{max}$. Thus, the initial scour rate $\dot{z}_i$ is obtained that corresponds to $\tau_{max}$. The initial scour rate $\dot{z}_i$ is the rate at which portions of the river bed 14 will scour away when the bed 14 is essentially unscoured, and the bed 14 does not have any substantial scour hole, such as the hole 18 depicted in FIG. 1.

A maximum depth of scour $z_{max}$ is then calculated. Using the results of flume tests, the inventors have developed the following equation:

$$z_{max}(\text{in mm})=0.18\ R_e^{0.635}$$

where Re is the Reynold's number previously identified. The same flume experiments conducted by the inventors have determined that scour depth versus time for a particular soil type can be modeled as a hyperbola with the following equation:

$$z = \frac{t}{\frac{1}{\dot{z}_i} + \frac{t}{z_{\max}}}$$

where $\dot{z}_i$ is the initial slope of the z versus t curve and $z_{max}$ is the ordinate of the asymptote. The parameter $z_{max}$ represents the final depth of scour at t=∞. Knowing $\dot{z}_i$ from the erosion function apparatus curve and $z_{max}$ from the previous equation, the complete curve is given by the hyperbolic equation for the design problem considered. A similar approach can be taken for other types of scour.

Figure 5:
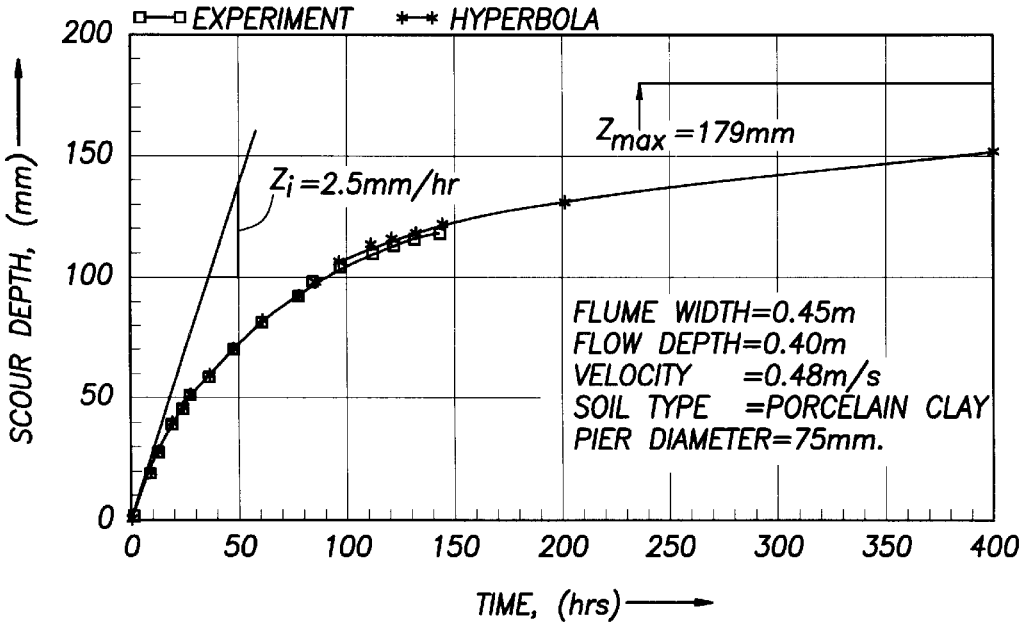
FIG. 5 depicts a relationship between scour depths and time for an exemplary pier.

An exemplary curve-fitted hyperbola is depicted in FIG. 5, and provides an example. $z_{max}$ is used as the asymptotic value of the hyperbola. In this instance, $z_{max}$ is 179 mm. $\dot{z}_i$, which is the initial scour rate, determined previously, provides the value (here 2.5 mm/hr) for the initial slope of the hyperbola.

The methods of the present invention permit the prediction and extrapolation of scour-related information for successive "flood events" wherein an expected water flow velocity is expected to occur for an expected period of time. Referring now to FIGS. 6A, 6B, 6C and 6D, such methods are illustrated. As FIG. 6A shows, flood event 1 has a velocity $v_1$ and lasts for a defined length of time $t_1$. Flood event 2 has a velocity $v_2$ and lasts for a period of time $t_2$.

FIG. 6B shows the relationship of scour depth versus time for the velocity $v_1$ caused by flood 1; while FIG. 6C shows the relationship of scour depth versus time for the velocity $v_2$ caused by flood 2. FIG. 6B shows that after $t_1$, a scour depth $z_1$ is reached. This depth $z_1$ would have been reached in an equivalent period of time $t_e$ (shown in FIG. 6C) if the bed 14 had been subjected to the velocity $v_2$ instead of $v_1$. Therefore, when flood event 2 begins, it is considered to be as if flood event 1 had not taken place and, instead, flood event 2 had been occurring for a time $t_e$. The time t2 of flood event 2 is added to $t_e$ and the scour depth after both flood events is $z_2$ corresponding to point C on FIG. 6C. The combined z versus t curve for the two flood events can be assembled as shown in FIG. 6D. More than two flood event curves may be combined in this manner. A large number of curves are best combined using a computer.

There are often layers of different material found in the bed 14. For example, a bed of sand may overlie a layer of clay. A composite $\dot{z}$ versus τ curve can be developed by averaging the $\dot{z}$ versus τ curves from all the different materials found in the bed 14 within the scour depth Z.

If the strength of the layers of material varies significantly, however, it may be necessary to perform a multilayer analysis. An example is explained with the aid of FIGS. 7A–7D. If the soil in the bed 14 is made up of a first layer 150, which is depicted graphically in FIG. 7C, and a second layer 152, that underlays the first layer 150. The first layer 150 is $\Delta z_1$ thick, and the second layer 152 is $\Delta z_2$ thick. Two separate scour depth (Z) versus time (t) curves, shown in FIGS. 7A and 7B, are developed. The time $t_1$ required to scour $\Delta z_1$ is found from the chart for layer 150 (FIG. 7A). After the time $t_1$, the scour depth versus time curve switched to the curve for layer 2. In FIG. 7D, this occurs at point "A" on the combined curve shown.

The calculations described herein may be performed by computer software, if desired, in order to eliminate the need for manual calculations.

It should be understood that while the invention has been herein shown and described in what is presently believed to be the most practical and preferred embodiments thereof, it will be apparent to those skilled in the art that many modifications may be made to the invention described while remaining within the scope of the claims.

What is claimed is:

1. A device for determining a predicted scour rate for soil samples, comprising:

a) a fluid flow conduit;

b) a pump to cause fluid to flow through the conduit at a selected rate of flow;

c) a soil introduction assembly to cause a selected amount of sampled soil to be introduced into the fluid flow conduit and thereby eroded by fluid flow through the conduit; and d) means for determining the rate of erosion for the selected amount of sampled soil.

2. The device of claim 1 wherein the means for determining the rate of erosion comprises a transparent viewing window.

3. The device of claim 1 further comprising a flowmeter for determining the rate of fluid flow through the fluid flow conduit.

4. The device of claim 3 wherein the flowmeter comprises a spinner-type flowmeter.

5. The device of claim 1 further comprising a plurality of pressure sensors operably interconnected to the fluid flow conduit to determine the shear stress on the sample.

6. A device for determining a predicted scour rate for soil, comprising:

a) a fluid flow conduit through which fluid is flowed;

b) a soil introduction assembly to introduce an amount of soil into the conduit for erosion of the soil by fluid flow along the conduit; and c) means for determining the rate of erosion for the amount of introduced soil.

7. The device of claim 6 wherein the means for determining the rate of erosion comprises a transparent viewing window.

8. The device of claim 6 further comprising a pump to cause fluid to flow through the conduit at a selected rate of flow.

9. The device of claim 6 further comprising a flowmeter to determine the rate of fluid flow through the conduit.

10. The device of claim 6 further comprising a fluid source operationally associated with the fluid flow conduit to supply fluid therefor.

11. The device of claim 6 wherein the soil introduction assembly comprises:

a cylinder for containing soil therein;

an aperture at an upper end of the cylinder;

a reciprocable piston interconnected proximate a lower end of the cylinder for movement of soil through the cylinder.

12. The device of claim 11 wherein the soil introduction assembly further comprises a step-type motor for movement of the piston.

13. A device for determining a predicted scour rate for an amount of soil to be eroded, comprising:

a) a container for retaining an amount of soil;

b) a fluid flow path associated with the container to direct flow to cause erosion of the amount of soil retained within the container;

c) means for causing fluid flow through the fluid flow path to erode the soil; and d) a device for selectively introducing an amount of soil into the flow path, the device comprising a reciprocable member that moves amounts of the erodable material out of the container and into the flow path.

14. The device of claim 13 wherein the means for causing fluid flow through the flow path comprises a fluid pump.

15. The device of claim 14 further comprising a fluid source operably interconnected with the fluid pump for providing fluid flow along the flow path.

16. The device of claim 15 further comprising a fluid collection receptacle to capture fluid.

17. The device of claim 13 further comprising a transparent viewing window for visually determining the rate of erosion of an amount of soil.

18. The device of claim 13 further comprising a flowmeter associated with the fluid flow path for measuring a rate of fluid flow along said path.

19. The device of claim 18 wherein the flowmeter comprises a spinner-type flowmeter.

* * * * *

UNITED STATES PATENT AND TRADEMARK OFFICE

CERTIFICATE OF CORRECTION

PATENT NO. : 6,260,409 B1
DATED : July 17, 2001
INVENTOR(S) : Briaud et al.

It is certified that error appears in the above-identified patent and that said Letters Patent is hereby corrected as shown below:

Column 4,
Line 48, change "a small amounts" to -- small amounts --.

Column 6,
Line 57, change "t" to -- $t_c$ --.

Column 7,
Line 8, change "RE" to -- $R_e$ --
Line 49, change "t2" to -- $t_2$ --.
Line 66, change ". The" to -- , the --.

Signed and Sealed this

Fourth Day of December, 2001

*Attest:*

Nicholas P. Godici

*Attesting Officer*

NICHOLAS P. GODICI
*Acting Director of the United States Patent and Trademark Office*